US011345456B2

(12) United States Patent
Kjellman

(10) Patent No.: US 11,345,456 B2
(45) Date of Patent: May 31, 2022

(54) COOLING SYSTEM FOR A WATER-BORNE VESSEL

(71) Applicant: Oceanvolt Oy, Vantaa (FI)

(72) Inventor: Janne Kjellman, Vantaa (FI)

(73) Assignee: Oceanvolt Oy, Vantaa (FI)

( * ) Notice: Subject to any disclaimer, the term of this patent is extended or adjusted under 35 U.S.C. 154(b) by 0 days.

(21) Appl. No.: 16/641,212

(22) PCT Filed: Aug. 8, 2018

(86) PCT No.: PCT/EP2018/071541
§ 371 (c)(1),
(2) Date: Feb. 21, 2020

(87) PCT Pub. No.: WO2019/038091
PCT Pub. Date: Feb. 28, 2019

(65) Prior Publication Data

US 2020/0223523 A1 Jul. 16, 2020

(30) Foreign Application Priority Data

Aug. 23, 2017 (GB) ..... 1713536

(51) Int. Cl.

| | |
|---|---|
| ***F01P 3/20*** | (2006.01) |
| ***B63H 21/38*** | (2006.01) |
| ***B63B 3/42*** | (2006.01) |
| ***F28D 1/02*** | (2006.01) |

(52) U.S. Cl.
CPC ..... *B63H 21/383* (2013.01); *B63B 3/42* (2013.01); *F28D 1/022* (2013.01)

(58) Field of Classification Search
CPC ..... B63H 21/38; B63H 21/383; B63B 3/42; B63B 2003/425; F01P 3/207; F28D 1/022
See application file for complete search history.

(56) References Cited

U.S. PATENT DOCUMENTS 4,360,350 A * 11/1982 Grover ..... B63J 2/12 114/140
4,767,367 A 8/1988 Stringer
(Continued)

FOREIGN PATENT DOCUMENTS

CN 106542073 A 3/2017
DE 2908133 A1 9/1980
(Continued)

OTHER PUBLICATIONS

Menon, Ajay. "Marine Propeller Shaft—Design And Construction" https://www.marineinsight.com/naval-architecture/marine-propeller-shaft-design-and-construction, Last Updated on Aug. 31, 2021, Retrieved Sep. 4, 2021 (Year: 2021).*
(Continued)

*Primary Examiner* — Andrew Polay

(57) ABSTRACT

A cooling system for a water-borne vessel (1) is disclosed. The system comprises a strut (5) for supporting a propeller shaft (4) of the vessel, the strut (5) comprising a fluid inlet (8), a fluid outlet (9), and a channel (10) inside the strut (5) for transporting fluid between the fluid inlet and fluid outlet, one or more fluid conduits coupling the fluid inlet and outlet to a component to be cooled, and a pump for circulating a fluid through the conduits and said channel.

6 Claims, 2 Drawing Sheets

(56) References Cited

U.S. PATENT DOCUMENTS

| | | | | |
|---|---|---|---|---|
| 5,445,099 | A * | 8/1995 | Rendina | B63B 3/38 114/140 |
| 8,864,538 | B1 * | 10/2014 | Arbuckle | B63H 21/383 440/88 C |
| 10,760,470 | B2 * | 9/2020 | Li | B63H 20/285 |
| 2004/0092177 | A1 * | 5/2004 | Creighton | B63H 23/36 440/82 |
| 2009/0235877 | A1 | 9/2009 | Cohen | |
| 2015/0017033 | A1 * | 1/2015 | Sakkinen | B63J 2/12 417/423.8 |

FOREIGN PATENT DOCUMENTS

| | | | |
|---|---|---|---|
| DE | 102010048897 | A1 | 4/2012 |
| GB | 2088804 | A | 6/1982 |

OTHER PUBLICATIONS

"Propeller Shaft Bearing Spacing" http://www.pacificmarine.net/engineering/propeller-and-propeller-shaft/propeller-shaft-bearing-spacing.htm, achieved publication Jun. 13, 2013, retrieved Sep. 4, 2013 (Year: 2013).*

"Wet Keels vs Dry Keels" https://www.retmarine.com/wet-keels-vs-dry-keels/, published May 13, 2020, (Year: 2020).*

International Search Report and Written Opinion for Application No. PCT/EP2018/071541, dated Nov. 28, 2018, 13 pages.

Search Report for GB Application No. GB1713536.9, dated Feb. 21, 2018, 6 pages.

International Preliminary Report on Patentability for Application No. PCT/EP2018/071541, dated Mar. 5, 2020, 8 pages.

* cited by examiner

COOLING SYSTEM FOR A WATER-BORNE VESSEL

CROSS-REFERENCE TO RELATED APPLICATION

This application is a national phase application of International Application No. PCT/EP2018/071541, filed on Aug. 8, 2018, and entitled "COOLING SYSTEM FOR A WATER-BORNE VESSEL", which is based on and claims priority to and benefit of British Patent Application No. GB1713536.9, filed on Aug. 23, 2017, and entitled "COOLING SYSTEM FOR A WATER-BORNE VESSEL". The entire disclosures of all of the above-identified applications are incorporated herein by reference.

TECHNICAL FIELD

The present invention relates to a heat exchanger for a water-borne vessel such as a ship or boat. In particular, though not necessarily, the invention relates to a heat exchanger suitable for cooling an electric motor of a water-borne vessel.

BACKGROUND

Water-born vessels such as ferries and other light commercial vessels are typically driven by high powered inboard internal combustion engines. These engines generate a significant amount of heat and the engines therefore require cooling to ensure that the engine temperature remains within acceptable operating limits. Cooling is also required for lower power engines such as those used on yachts and other pleasure crafts.

Inboard engines are typically cooled by circulating coolant around a circuit including a heat exchanger and the engine. The coolant absorbs heat from the motor, and gives off the heat at the heat exchanger. Various types of inboard engine heat exchangers are known and may involve the use of sea water (or fresh lake or river water) to absorb the heat from the coolant. This may involve pumping cold seawater from beneath the vessel into the heat exchanger and then pumping the heated seawater back into the sea.

German patent application number DE-1 02005002456 discloses a heat exchanging keel for cooling an engine. The keel comprises integrated cooling coils through which coolant flows. Whilst the keel provides an extremely large surface area and therefore excellent heat exchange capacity, it is an expensive component to construct for a new build. It is also difficult to adapt or retrofit a keel in the case of an existing vessel. Of course, many vessels such as motorboats do not have a keel so this solution is not appropriate.

SUMMARY OF THE INVENTION

It is an object of the present invention to provide a cooling system for a water-borne vessel that is simple and cheap to produce, is straightforward to fit or retro-fit. and does not negatively impact on vessel handling characteristics to a significant extent.

According to a first aspect of the present invention there is provided a cooling system for a water-borne vessel comprising a propeller shaft extending from a bow end at which the shaft is driven by an inboard electric motor to a stern end at which a propeller is fixed to the propeller shaft, the cooling system. The cooling system comprises a strut in the form of a highly thermally conducting structure for attachment to the bottom of the vessel's hull, at the stern end, for supporting the propeller shaft of the vessel, the strut comprising a fluid inlet, a fluid outlet, and a channel or channels within the strut for transporting fluid between the fluid inlet and fluid outlet, one or more fluid conduits for location inside the vessel's hull for coupling the fluid inlet and fluid outlet to the inboard electric motor and/or batteries thereof to be cooled, and a pump for circulating a fluid through the conduits and said channel(s). Cooling of a fluid of the cooling system is provided substantially only as it flows through the strut.

The strut may comprise a bearing for supporting a propeller shaft and for facilitating rotation of the shaft with the strut. The strut may be formed substantially of a metal or metal alloy, for example stainless steel, brass, aluminium, or an allow of brass and aluminium.

According to a third aspect of the present invention, there is provided a vessel comprising the cooling system of the above first aspect of the invention.

DETAILED DESCRIPTION

The marine industry is increasingly interested in the use of electric motors to propel vessels. This is due to a number of factors including environmental, performance, and efficiency. One advantage of electric motors is the reduced amount of heat that they produce, meaning that cooling systems can be simplified. In particular only a relatively small heat exchanger may be required. One might consider providing a dedicated component beneath a boat's hull and which has a surface area exposed to the sea water. However, whilst such a component may provide efficient cooling, it adds an extra cost and may also add to the hull's drag factor.

Figure 1:
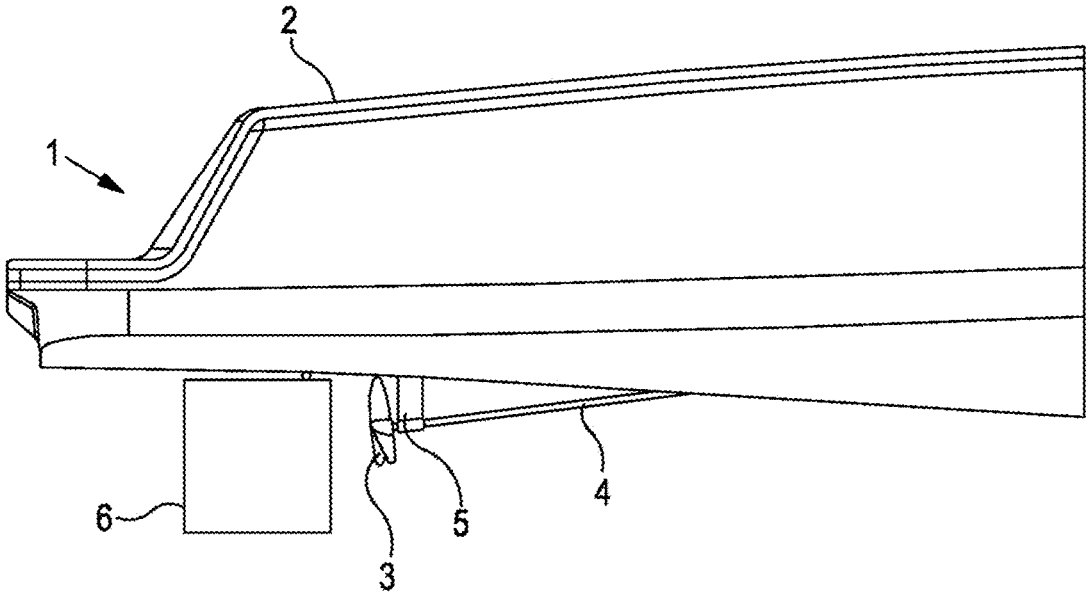
FIG. 1 is a side view of a stern portion of a water-borne vessel.

FIG. 1 is a side view of a water-borne vessel 1. The vessel 1 comprises a hull 2, propeller 3. propeller shaft 4. propeller shaft strut 5. and rudder 6. When the vessel is in water, the propeller 3. propeller shaft 4. propeller shaft strut 5 and rudder 6 are below the water line. The propeller shaft 4 is driven to rotate by a motor inside the vessel, and in particular by an inboard electric motor (not shown in the Figure). Rotation of the propeller shaft 4 results in rotation of the propeller 3, and hence propulsion of the vessel 1 through the water. The propeller shaft strut 5 supports the propeller shaft 4 within a bearing such that the shaft is allowed to rotate within the strut 5 but is prevented from flexing and vibrating (to any significant extent) and the propeller 3 prevented from coming into contact with the hull 2.

Figure 2:
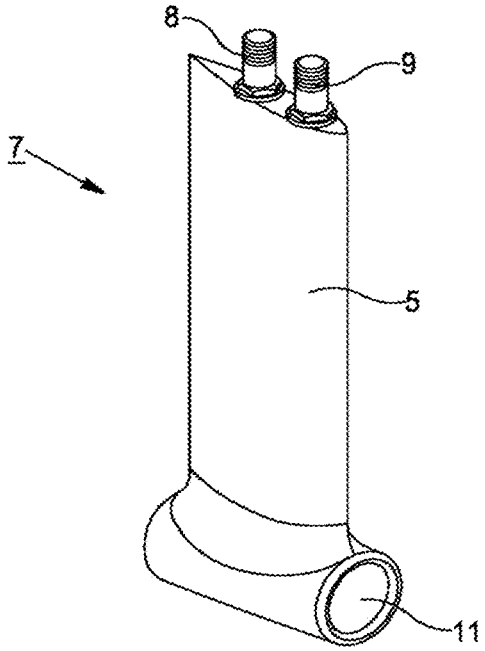
FIG. 2 is a perspective view of a heat exchanger according to an embodiment of the invention.
Figure 3:
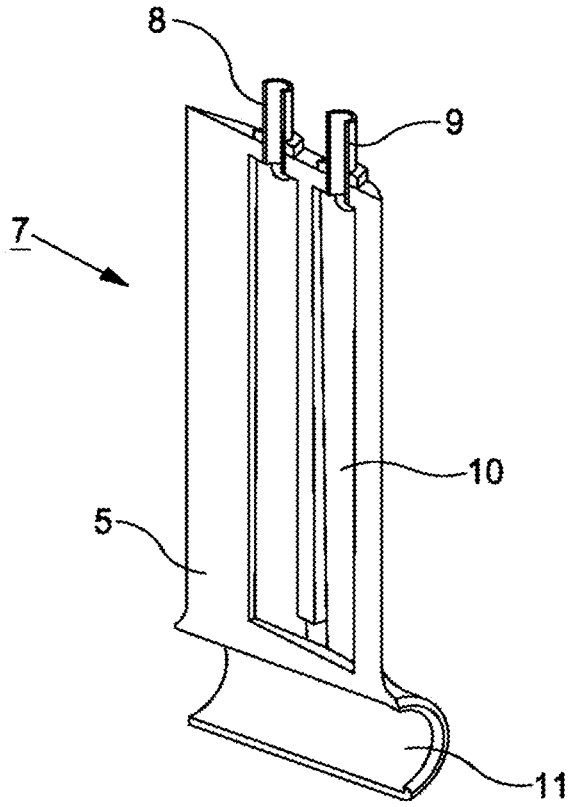
FIG. 3 is a cut-away view of the heat exchanger of FIG. 2.

FIG. 2 is a perspective view a propeller shaft strut 5 according to an embodiment of the invention whilst FIG. 3 is a cut-away view of the same propeller shaft strut 5. In this embodiment the propeller shaft strut 5 is configured to operate also as a heat exchanger 7. The strut 5 comprises a cooling fluid inlet 8. a cooling fluid outlet 9. a cooling channel 10 and a propeller shaft channel 11 into which a bearing is integrated (not shown). The cooling channel 10 allows fluid entering through the cooling fluid inlet 8 to circulate within the propeller shaft strut 5 and out through the cooling fluid outlet 9. The fluid may be water or another suitable liquid. The channel 10 is isolated from the outer surface of the strut 5, to prevent mixing of cooling fluid inside the strut and water outside the strut.

The propeller shaft strut 5 is a highly thermally conducting structure which in use is located below the waterline. For example, the propeller shaft strut 5 may be cast or machined out of bronze or stainless steel. The propeller shaft strut 5 is preferably located in front of the propeller 3 in the direction of motion of the water vessel 1. The temperature of the propeller shaft strut 5 is thus very close to the temperature of the water surrounding the propeller shaft strut 5.

Whilst FIG. 3 illustrates a simple generally U-shaped cooling channel 10, the channel may have a more convoluted shape, such as a zig-zag shape, so as to increase the cooling surface area of the channel that is exposed to coolant. The cooling channel 10 is preferably near the outer surface of the propeller shaft strut 5 so as to enable efficient heat exchange between the cooling fluid and the surrounding water.

Whilst the propeller shaft strut 5 is a relatively small component, and therefore is able to provide only limited cooling capacity, it has been found that this is sufficient for certain efficient electric motors. Moreover, the modified propeller shaft strut 5 can be easily retro-fitted to existing vessels, for by example replacing an existing propeller shaft strut with a modified propeller shaft strut. Furthermore, because the propeller shaft strut 5 is a direct replacement of an existing propeller shaft strut on a vessel, the handling characteristics of the vessel, such as maneuverability and top speed, are not adversely affected to any significant extent.

Figure 4:
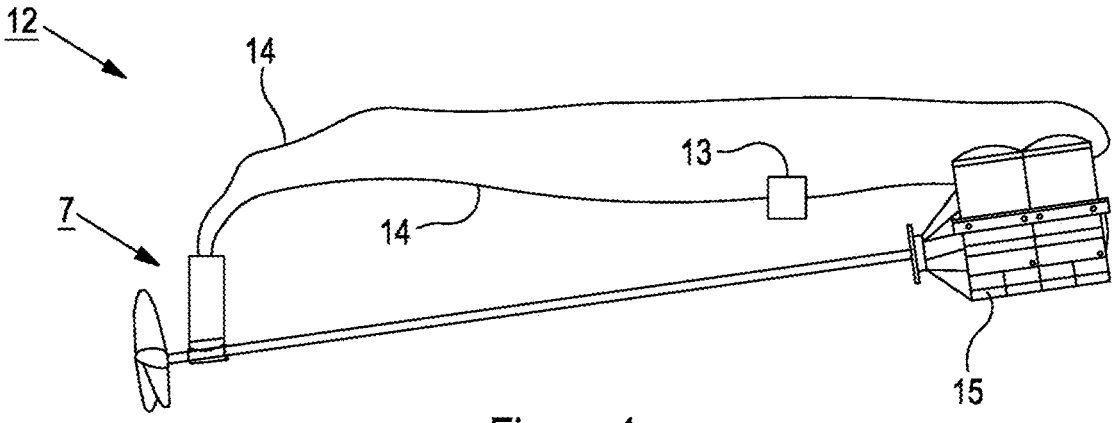
FIG. 4 illustrates a cooling system according to an embodiment of the invention.

FIG. 4 illustrates schematically a cooling system 12 incorporating the propeller shaft strut 5 described above. The cooling system comprises the modified propeller shaft strut 5. coolant pump 13 and coolant tubes or pipes 14. The cooling system 12 cools an electric motor 1 5 that heats up in use and requires cooling. The cooling system 12 is shown coupled directly to the electric motor 15 but indirect coupling is also possible. For example, the electric motor may have an internal cooling system with its own heat exchanger in which case the cooling system 12 provides a means for cooling the internal heat exchanger.

In use. the coolant pump 13 circulates cooling fluid around the cooling system 12. Lower temperature cooling fluid flows from the heat exchanger 7, through the coolant pump 13 and to the device 15. The cooling fluid absorbs heat emitted by the device 15 and the higher temperature cooling fluid flows to the heat exchanger 7. The heat exchanger 7 conducts heat away from the cooling fluid, thus reducing the temperature of the cooling fluid before the cooling fluid is fed back towards the device.

In the embodiment shown in FIG. 4, the cooling system is used to cool an electric motor. However the invention may be used to cool any device that requires moderate cooling in operation. For example, batteries and air conditioning components may be cooled by the cooling system.

It will be appreciated by persons skilled in the art that various modifications may be made to the above embodiments without departing from the scope of the present invention.

What is claimed is:

1. A cooling system for a water-borne vessel comprising a propeller shaft extending from a bow end at which the propeller shaft is driven by an inboard electric motor to a stern end at which a propeller is fixed to the propeller shaft, the cooling system comprising:

a strut in a form of a thermally conducting structure attached to a bottom of a vessel's hull and at the stern end, for supporting the propeller shaft of the vessel, the strut comprising a fluid inlet, a fluid outlet, and a channel or channels within the strut for transporting a fluid between the fluid inlet and fluid outlet, the strut being a cast or machined out of a thermally conductive material, wherein an interior surface of the strut forms the channel or channels, and heat of the fluid in the channel or the channels is dissipated to surrounding water through the thermally conductive material filled between the interior surface of the strut and an exterior surface of the strut;

one or more fluid conduits located inside the vessel's hull for coupling the fluid inlet and fluid outlet to the inboard electric motor and/or batteries thereof to be cooled; and a pump for circulating the fluid through the fluid conduits and the channel or channels, wherein cooling of the fluid of the cooling system is provided substantially when the fluid flows through the strut.

2. The cooling system according to claim 1, wherein the strut comprises a bearing for supporting the propeller shaft and for facilitating rotation of the propeller shaft within the strut.

3. The cooling system according to claim 1, wherein the strut is formed substantially of a metal.

4. The cooling system according to claim 3, wherein the metal comprises steel or brass.

5. The vessel comprising the cooling system according to claim 1.

6. The cooling system according to claim 1, wherein the channel or channels have a convoluted shape.

* * * * *